US005952941A

United States Patent [19]

Mardirossian

[11] Patent Number: 5,952,941

[45] Date of Patent: Sep. 14, 1999

[54] SATELLITE TRAFFIC CONTROL AND TICKETING SYSTEM

[75] Inventor: Aris Mardirossian, Germantown, Md.

[73] Assignee: I0 Limited Partnership, L.L.P., Derwood, Md.

[21] Appl. No.: 09/026,773

[22] Filed: Feb. 20, 1998

[51] Int. Cl.[6] ..... G08G 1/01

[52] U.S. Cl. ..... 340/936; 340/905; 340/996; 340/539; 701/119

[58] Field of Search ..... 340/905, 936, 340/996, 53 P; 701/119

[56] References Cited

U.S. PATENT DOCUMENTS

| | | | |
|---|---|---|---|
| 3,680,043 | 7/1972 | Angeloni | 340/936 |
| 3,686,628 | 8/1972 | Keller et al. | 340/905 |
| 4,591,823 | 5/1986 | Horvat | 340/936 |
| 4,816,827 | 3/1989 | Baloutch et al. | 340/905 |
| 5,144,553 | 9/1992 | Hassett et al. | 340/928 |
| 5,196,846 | 3/1993 | Brockelsby et al. | 340/933 |
| 5,278,563 | 1/1994 | Spiess | 342/44 |
| 5,289,183 | 2/1994 | Hassett et al. | 340/905 |
| 5,313,200 | 5/1994 | Sone | 340/905 |
| 5,315,295 | 5/1994 | Fujii | 340/936 |
| 5,570,087 | 10/1996 | Lemelson | 340/936 |
| 5,742,240 | 4/1998 | Asanuma et al. | 340/936 |

*Primary Examiner*—Daniel J. Wu
*Attorney, Agent, or Firm*—Joseph A. Rhoa

[57] ABSTRACT

A system and corresponding method for monitoring traffic violations. A satellite based system determines the location, and upon which roadway, a vehicle is traveling. A memory (e.g. RAM) in the vehicle system stores speed limit data relating to different roads, speed limits, and/or red lights across the globe. A controller in the vehicle compares, for example, speed limit data relative to determined speed of the vehicle so as to detect when the speed limit on the road upon which the vehicle is traveling is exceeded. When the speed limit is exceeded, a transmitter on the vehicle transmits a signal to at least one satellite indicative of the violation. The at least one satellite forwards the violation signal to a motor vehicle department so that a ticket can be issued to the vehicle operator. In a similar manner, the satellite based system can detect other infractions such as running of red lights, and issue tickets in response to same.

12 Claims, 2 Drawing Sheets

SATELLITE TRAFFIC CONTROL AND TICKETING SYSTEM

This invention relates to a satellite based traffic control system for monitoring and reporting vehicle violations such as exceeding speed limits, running red lights, etc.

BACKGROUND OF THE INVENTION

Traffic surveillance systems are old and well-known throughout the art. For example, see U.S. Pat. No. 4,591,823 (the U.S. Pat. No. '823), the disclosure of which is incorporated herein by reference.

The U.S. Pat. No. '823 discloses a traffic speed surveillance system including a set of monitor transceivers located along a roadway and communicating with a central processor. A vehicle transceiver is mounted in a vehicle and includes means for entering driver identification and vehicle identification, and a speedometer for measuring the speed of the vehicle. The vehicle transceiver receives radio signals from a monitor transceiver indicative of speed limit and compares measured speed against the limit, and sends radio signals indicative of driver identification, vehicle identification, and speed limit violation to the monitor in the transceiver for reporting to the central processor.

Unfortunately, the traffic surveillance system of U.S. Pat. No. 4,591,823 suffers from at least the following problems. In the system of the U.S. Pat. No. '823, there is a need for an extraordinarily high number of monitor transceivers to be located along roadways all around the country or globe. Such a high number of transceiver monitors is expensive, burdensome, and susceptible to vandalism and damage. Such devices are also aesthetically unattractive. It would be nearly impossible to provide all roadways across the country or globe with monitor transceivers, as this would be both impractical and unduly expensive.

In view of the above, it will be apparent to those of skill in the art that there exists a need in the art for an improved traffic violation surveillance system that does not require monitor devices to be positioned along each and every roadway to be monitored. Such a system should be both cost effective and efficient.

It is the purpose of this invention to fulfill the above-described needs in the art, as well as other needs in the art which will become more apparent to the skilled artisan once given the following disclosure.

SUMMARY OF THE INVENTION

Generally speaking, this invention fulfills the above-described needs in the art by providing a satellite based system for monitoring and detecting traffic violations, the system comprising:

a plurality of satellites orbiting around planet Earth;

a vehicle including a satellite receiver, speedometer, a memory, a controller, a satellite transmitter, and operator identification input means;

said operator identification input means for enabling a vehicle operator to input information identifying the operator so that such information is stored in the system whereby the controller knows the identity of the vehicle operator;

said speedometer monitoring speed of the vehicle;

said memory storing speed limit data of a plurality of different roads;

said receiver for receiving signals from the satellites so that the controller is informed as to the location of the vehicle on Earth and so that the controller can determine on what road on Earth the vehicle is traveling;

said controller including means for determining whether the speed limit on the road on which the vehicle is traveling is being exceeded by the vehicle; and means for transmitting via said transmitter a violation signal to at least one of the satellites when the controller determines that the speed limit is being exceeded by the vehicle, so that a violation ticket can be issued to the operator of the vehicle when the speed limit is exceeded.

Satellite(s) in orbit can pick up violation signals and signal the position of thousands of vehicles or cars on roadways across the globe, with these violation signals received by the satellite(s) being digitally transmitted to receiving computers located at state-run motor vehicle departments or facilities. In such a manner, the state-run motor vehicle facilities/departments issue tickets to vehicle operators or owners in response to receiving violation signals.

This invention will now be described with respect to certain embodiments thereof, along with reference to the accompanying illustrations wherein.

IN THE DRAWINGS

DETAILED DESCRIPTION OF CERTAIN EMBODIMENTS OF THIS INVENTION

Figure 1:
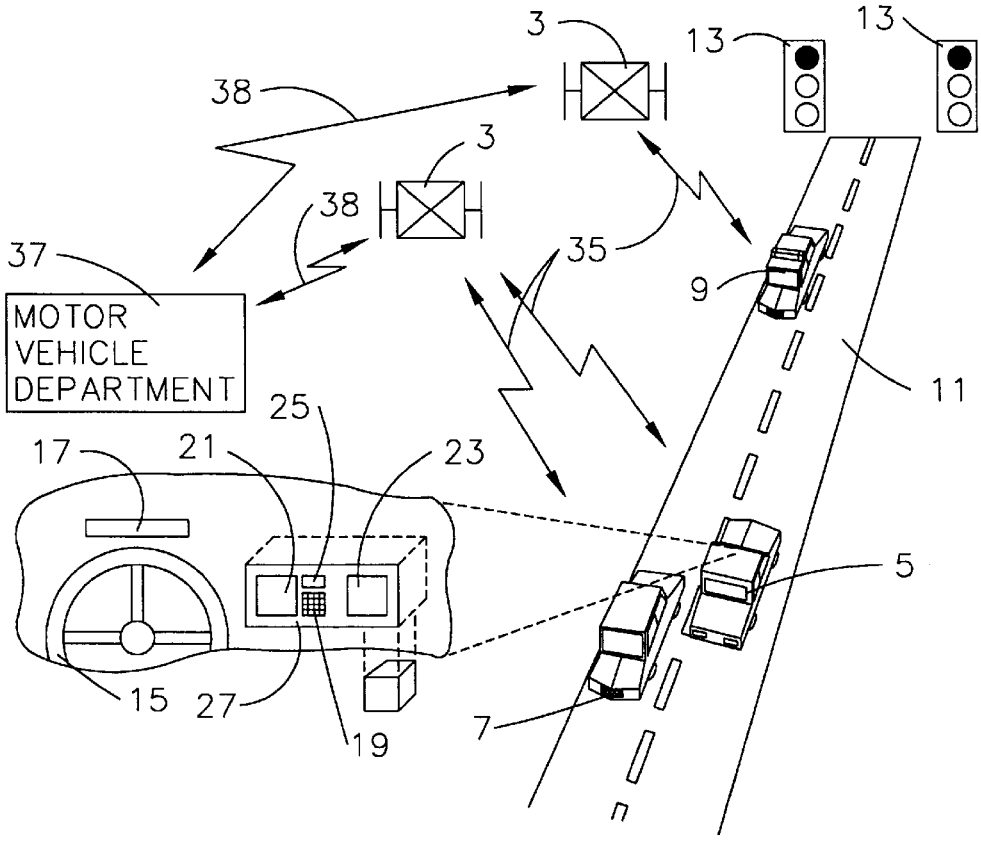
FIG. 1 is a schematic illustration of a satellite based traffic monitoring system according to an embodiment of this invention.

Referring now more particularly to the following illustrations where like reference numerals indicate like parts throughout the several views.

FIG. 1 is a schematic illustration of a satellite based traffic surveillance system according to an embodiment of this invention. The system includes a plurality of orbiting satellites 3 provided around the planet Earth, numerous automobiles or other vehicles 5, 7, and 9 which drive/travel on roadways 11, red lights 13 provided on the roadway system, each automobile/vehicle 5, 7, 9 including a steering mechanism (e.g. steering wheel) 15, speedometer 17, alarm 19, LCD display 21, keyboard 23, card reader or other driver ID input device 25, and housing 27 for mounting/housing any or all of elements 17–25.

Figure 2:
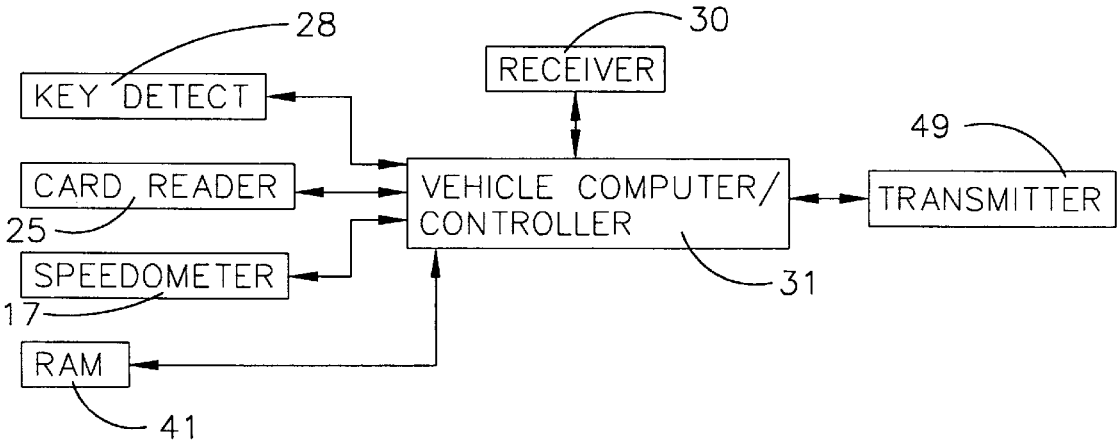
FIG. 2 is a block diagram of computer and other components within automobiles/vehicles in accordance with the FIG. 1 embodiment of this invention.
Figure 3:
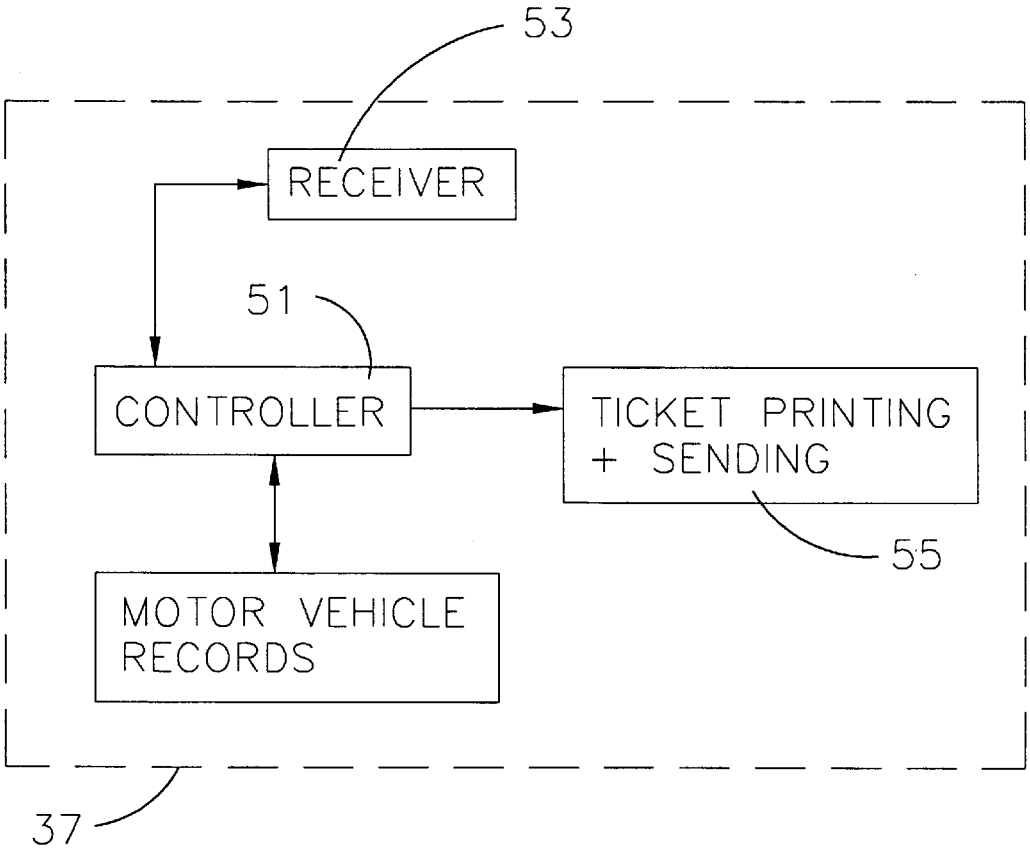
FIG. 3 is a block diagram of computer and other components located at a motor vehicle governmental location in accordance with the FIGS. 1–2 embodiment of this invention.

Referring to FIGS. 1–2, each vehicle includes card reader 25, or any other suitable input device for inputting data, for entering driver identification information such as driver's license number, social security number, passport number, or the like. Furthermore, vehicle identification information (e.g. license plate number and/or serial number) may be entered via input 25. In such a manner, the identification of the driver and/or vehicle is entered into the computer/controller 31 in each vehicle. In certain embodiments, controller 31 prevents a vehicle from being started or operated until a satisfactory identification (driver and/or vehicle) has been entered via input 25. Thus, no vehicle can be operated unless the driver first enters, for example, his/her driver's license or social security number into the computer system on the vehicle, so that controller 31 always knows who is operating the vehicle. The magnetic strip on the rear side of a typical driver's license may be used, for example, to enter ID data into input 25 re driver's license numbers.

Speedometer 17 monitors and continually outputs the speed of the corresponding vehicle 5, 7, 9. Speedometer may be of the digital or analog type. Key detect 28 senses when a key is inserted into a starting device of the vehicle, and prevents the vehicle from staring until controller 31 instructs detect 28 to enable starting after controller 31 is informed that satisfactory identification data indicative of driver ID and/or vehicle ID has been entered into the system via input device 25.

Receiver 30 is provided for receiving communications 35 from satellite(s) 3 that tell the vehicle controller 31 where globally the vehicle is located (via known GPS technology) so that such information can be compared with roadmap information stored in RAM 41 whereby controller 31 knows what road the vehicle is on and what the road's speed limit is. Satellites 3 are part of, and function in accordance with the known global positioning system (GPS). Satellites communicate 35 with all vehicles 5, 7, 9 via satellite transmission/reception signals 35. Satellites 3 also communicate 38 with motor vehicle department 37 in order to report traffic violations and the like. By simultaneously being able to access this roadway map in RAM or ROM 41, and determine the global position of the vehicle via satellites 3 and GPS, the satellite system and/or controller 31 in the vehicle can be informed upon which roadway the vehicle is traveling or sitting. RAM 41 also stores the speed limits for each road stored (preferably for each road on the Earth). Thus, controller 31 in each vehicle knows wich roadway the vehicle is on and controller 31 also knows the speed limit of the road upon which the vehicle is traveling.

When controller 31, via communicating with speedometer 17, determines that the vehicle is exceeding the speed limit of the road upon which the vehicle is traveling, then controller 31 instructs transmitter 49 to send a violation or alarm signal to satellite(s) 3, which signal is then relayed to motor vehicle department 37. This violation or alarm signal sent by transmitter 49 includes violation information identifying the infraction (e.g. speed limit exceeding), driver identification data, and/or vehicle identification data. When department 37 receives 53 such an alarm or violation signal, it analyze the content of the signal to determine the violation via controller 51, and the operator and/or vehicle who committed the infraction. Controller 51 then instructs printing/sending station 55 to print a ticket in the name of the operator of the automobile and send the operator a copy of the ticket via mail or e-mail, requiring payment for the reported violation. The name, address, etc. of the operator of the vehicle is sent from vehicle transmitter 49 to satellite(s) 3 along with the alarm or violation signal, so that the motor vehicle department is informed who the vehicle operator is.

In certain embodiments of this invention, motor vehicle department 37 is a state owned or state run facility or department. For example, the State of Maryland may run or operate facility 37. In certain embodiments, each State in the U.S.A. may have at least one state owned or state run facility 37. Signals received by facility 37 from satellites 3 are in digital form in certain embodiments so that receiver 53 can receive these digitally encoded signals and the state run facility or department can issue tickets to either vehicle owners or vehicle operators in response to the receipt of violation signals.

According to alternative embodiments of this invention, controller 31 on each vehicle may determine a violation of speed limit, traffic light, etc., and instead of transmitting a digital signal 35 via transmitter 49 to at least one satellite, the controller 31 may cause the violation to be electronically stored in RAM 41 so that at a later point in time violations stored in RAM 41 (or any other type of known memory) can be downloaded to a state run facility 37 either directly or indirectly so that facility 37 can issue tickets for the violations.

In certain embodiments of this invention, controller 31 includes a built in delay device which delays sending an alarm/violation signal to satellite(s) 3 for a predetermined period of time (e.g. from about 5–30 seconds) in order to allow the vehicle operator to remedy or stop the violation behavior. If the operator stops the violating occurrence (e.g. if the operator slows to a speed less than or equal to the speed limit) within the predetermined time period, then no violation or alarm signal will be sent by transmitter 49 and no ticket will be issued to the operator by department 37. If however, the predetermined time period of delay elapses, and the violation is still occurring (e.g. if the operator/vehicle is still exceeding the speed limit), then transmitter 49 is instructed to send the violation signal discussed above to at least one satellite 3 so that a ticket to the operator results.

In further embodiments, the satellite based system of this invention may be used to detect and ticket operators who run red lights or commit any other traffic violation. For example, in red light violation detection embodiments, RAM 41 stores data indicative of where red lights 13 are located on roadways 11 across the globe. Because controller 31 knows on what road the vehicle is located as discussed above, and where red lights 13 are located relative to those roads, controller 31 knows when red lights are being approached and passed through by the vehicle. Each red light 13 includes a built in transmitter for emitting a "red" signal and a "green" signal (these signals are received by receiver 30 in each vehicle) so as to indicate the status of a light that is proximate the vehicle. When controller 31 determines that the vehicle passed through a light 13 that is emitting a "red" signal when the light was passed, transmitter 49 is instructed to send a violation signal to satellites 3 which in turn send a violation signal to department 37 so that a violation ticket can be issued to the vehicle operator. However, when controller 31 determines that the vehicle passed through a light 13 which was emitting a "green" signal, this of course is normal and no violation or any other signal is sent from transmitter 49.

Once given the above disclosure, many other features, modifications, and improvements will become apparent to the skilled artisan. Such other features, modifications, and improvements are, therefore, considered to be a part of this invention, the scope of which is to be determined by the following claims.

I claim:

1. A satellite based system for monitoring and detecting traffic violations, the system comprising:

a plurality of satellites orbiting around planet Earth;

a vehicle including a satellite receiver, speedometer, a memory, a controller, a satellite transmitter, and operator identification input means;

said operator identification input means for enabling a vehicle operator to input information identifying the operator so that such information is stored in the system;

said speedometer monitoring speed of the vehicle;

said memory storing speed limit data of a plurality of different roads;

said receiver for receiving signals from the satellites so that the controller is informed as to the location of the vehicle on Earth and so that the controller can determine on what road on Earth the vehicle is travelling;

said controller including means for determining whether the speed limit of the road on which the vehicle is traveling is being exceeded by the vehicle; and means for transmitting via said transmitter a violation signal to at least one of the satellites when the controller determines that the speed limit is being exceeded, so that a violation ticket can be issued to the operator of the vehicle when the speed limit is exceeded.

2. The system of claim 1, wherein said transmitter of the vehicle sends the violation signal to at least one satellite in a digital manner.

3. The system of claim 2, further including a plurality of state-run or state-controlled motor vehicle departments or facilities (37), and wherein each of said state-run or state-controlled motor vehicle departments includes a receiver for receiving signals from satellites.

4. The system of claim 3, wherein each of the state-run or state-controlled motor vehicle departments or facilities includes means for receiving signals from satellites indicative of a vehicle exceeding the speed limit, and means for issuing a speeding ticket to an operator or owner of the vehicle indicated to have exceeded the speed limit.

5. The system of claim 3, further comprising delay means in the vehicle, said delay means providing a predetermined amount of time to an operator of the vehicle to stop exceeding the speed limit before the violation signal is transmitted via said transmitter of the vehicle, so that if the vehicle operator stops speeding within the predetermined amount of time defined by said delay means, then no violation signal is transmitted and no ticket will issue for speeding which took place within the predetermined amount of time.

6. The system of claim 5, wherein said predetermined amount of time is from about 5–120 seconds.

7. The system of claim 6, wherein said predetermined amount of time is from about 5–30 seconds.

8. The system of claim 5, wherein said controller includes means for instructing said transmitter to transmit the violation signal only when exceeding of the speed limit by the vehicle continues entirely through and beyond the predetermined amount of time defined by said delay means.

9. The system of claim 8, wherein said delay means is within the controller.

10. A method of monitoring and detecting traffic violations, the method comprising the steps of:

providing a plurality of satellites orbiting around planet Earth;

providing a vehicle including a receiver, speedometer, a memory, a controller, a transmitter, and operator identification means;

an operator inputting identification data into the operator identification means so that the controller is informed as to the operator of the vehicle;

said speedometer monitoring speed of the vehicle on a road;

said memory storing speed limit data of a plurality of different roads;

receiving signals from the satellite so that the controller can determine on what road on planet Earth the vehicle is traveling;

determining whether the speed limit of the road on which the vehicle is traveling is being exceeded by the vehicle; and when it is determined that the speed limit is being exceeded, transmitting via the transmitter a violation signal to at least one of the satellites so that a violation ticket can be issued to the operator of the vehicle when the speed limit is exceeded.

11. The method of claim 10, further comprising the step of determining whether the speed limit is being exceed by the vehicle for a predetermined period of time greater than about 5 seconds, and transmitting the violation signal via the transmitter only when it has been determined that the speed limit has been exceeded for at least said predetermined period of time.

12. A method of monitoring traffic and issuing tickets in response to traffic law infractions, the method comprising the steps of:

providing a plurality of orbiting satellites around Earth;

providing at least one vehicle for traveling on a roadway, the at least one vehicle including a satellite receiver, a satellite transmitter, and a controller;

the vehicle receiving positional signals from the satellites which indicate the location of the vehicle on Earth;

the controller determining, based at least in part upon the received positional signals, on what roadway the vehicle is traveling;

a memory of the vehicle storing traffic law information including at least one of speed limit information and traffic light information;

the controller determining, based at least in part upon the location of the vehicle determined from the received positional signals, whether traffic laws are violated by the vehicle and when it is determined that such laws are or have been violated by the vehicle the controller causing the transmitter to transmit a violation signal to at least one satellite in response thereto so that a ticket can be issued for the traffic law violation to one of the operator and owner of the vehicle.

* * * * *